United States Patent [19]

Kitayama et al.

[11] Patent Number: 4,478,573

[45] Date of Patent: Oct. 23, 1984

[54] FURNACE FOR HEATING PIPES WITH UPSET PORTIONS

[75] Inventors: Hideo Kitayama, Mino; Haruho Niwa, Tokai, both of Japan

[73] Assignees: Chugai Ro Co., Ltd., Osaka; Kawasaki Steel Corp., Hyogo, both of Japan

[21] Appl. No.: 457,030

[22] Filed: Jan. 10, 1983

[30] Foreign Application Priority Data

Jan. 13, 1982 [JP] Japan ..... 57-3464[U]

[51] Int. Cl.[3] ..... F27B 9/14; F27B 9/00

[52] U.S. Cl. ..... 432/124; 432/10; 432/11; 432/144; 432/148

[58] Field of Search ..... 432/10, 11, 124, 144, 432/145, 148

[56] References Cited

U.S. PATENT DOCUMENTS 2,294,019 8/1942 Boyle ..... 432/10

2,296,806 9/1942 Buckholdt ..... 432/10

FOREIGN PATENT DOCUMENTS 55-94442 7/1980 Japan .

*Primary Examiner*—John J. Camby

*Attorney, Agent, or Firm*—Jackson, Jones & Price

[57] ABSTRACT

A furnace for heating pipes each having an upset portion at least at one of its opposite ends includes a housing defining a heating chamber filled with high temperature gas, and a conveying apparatus for sequentially conveying the pipes in the housing in a direction perpendicular to an axial direction of the pipes. A blowing device is provided on one side of a path of the upset portion, and a waving plate is provided on the other side of the path, whereby the upset portion, when passing through a space between the blowing device and the plate, is heated locally by the high temperature gas blown out from the blowing device and also by the reflected high temperature gas and radiant heat from the plate.

12 Claims, 7 Drawing Figures

FURNACE FOR HEATING PIPES WITH UPSET PORTIONS

BACKGROUND OF THE INVENTION

1. Field of the Invention

The present invention relates to a heating furnace and, more particularly, to a continuous heating furnace with a local heating device employed therein for uniformly heating workpieces each having a bar like configuration with an upset portion at least at one of its opposite ends.

2. Description of the Prior Art

In heating bar like articles such as pipes, tubes, rods and the like (generally referred to as pipes), for heat-treating purposes or for bringing them to required temperatures for subsequent operations, it is very important that the workpieces be uniformly heated throughout. For this purpose, a furnace provided with a conveying apparatus is known, such as disclosed in Charles MacGregor's U.S. Pat. No. 2,858,122 issued Oct. 28, 1958, which comprises: a furnace having an entry port, from which the pipes and the like are inserted in its axial direction one after another with a predetermined interval; a conveying apparatus provided in the furnace for laterally conveying the pipes in a direction perpendicular to said axial direction; and an exit portion, from which the heated pipes are expelled. According to this prior art, the pipes are heated during their lateral conveyance in the furnace and, therefore, the furnace has a predetermined size capable of heating the pipes to the required temperatures.

In the case where the pipes have an upset portion, where the diameter is increased, at its one end or at its opposite ends, additional heat must be added to such an upset portion to bring the whole pipe to the required temperatures. To accomplish this, one may propose to enlarge the size of the furnace to elongate the distance of lateral conveyance of the pipe, thus keeping the pipe in the furnace for a long time. This arrangement however, results in a bulky size of furnace and in an increase of occurrence of scaling of the pipes. Furthermore, the fuel necessary to heat up the furnace would increase greatly when compared with a small increase (several %) in weight in the pipe.

To overcome such drawbacks, there has been proposed an improved furnace having a pre-heating device provided externally to the furnace for pre-heating the upset portions before the pipes enter into the furnace, whereby the upset portions can be heated in the furnace up to the required temperatures in a period of time which is about the same time required for heating a body portion of the pipe (a portion other than the upset portions).

The employment of such a pre-heating device, which is provided with a burner or inductor for effecting the heating, results not only in an increase of the initial cost and running cost, but also in an increase of heating time. Furthermore, it results in an increase of the entire size of the furnace because of such a pre-heating device provided externally.

Another improved furnace has been proposed and is disclosed in Japanese Laid-Open Patent Application No. 55-94442 issued July 17, 1980, and both of the present inventors are co-inventors of the improved furnace disclosed therein. According to this improved furnace, a blower is provided on one or both sides of a path of the upset portion for blowing high temperature gas towards the path of the upset portion. This improved furnace, however, has a drawback in effective and efficient utilization of the blown out high temperature gas.

SUMMARY OF THE INVENTION

The present invention has been developed with a view to substantially solving the above described disadvantages and has as its essential object to provide an improved heating furnace having a local heating device employed therein for uniformly heating moving workpieces each having a bar like configuration with an upset portion at least at one of its opposite ends.

It is also an essential object of the present invention to provide a heating furnace of the above described type which can be formed with hardly any increase in the size of furnace.

In accomplishing these and other objects, a heating furnace according to the present invention comprises a housing defining a heating chamber, a means for sequentially conveying elongated workpieces in the housing in a direction perpendicular to an axial direction of the elongated workpieces, a means for providing high temperature gas in the housing, a means provided on one side of a path of the upset portion for blowing high temperature gas towards the path of the upset portion, and plate means provided in face-to-face relation to the blowing means and on a side opposite to the one side of the path of the upset portion for reflecting blown out high temperature gas and radiating heat towards the path, whereby the upset portion, when passing through a space between the blowing means and the plate means, is heated locally.

BRIEF DESCRIPTION OF THE DRAWINGS

These and other objects and features of the present invlention will become apparent from the following description taken in conjunction with a preferred embodiment thereof with reference to the accompanying drawings, throughout in which like parts are designated by like reference numerals, and in which.

DESCRIPTION OF THE PREFERRED EMBODIMENTS

Figure 1:
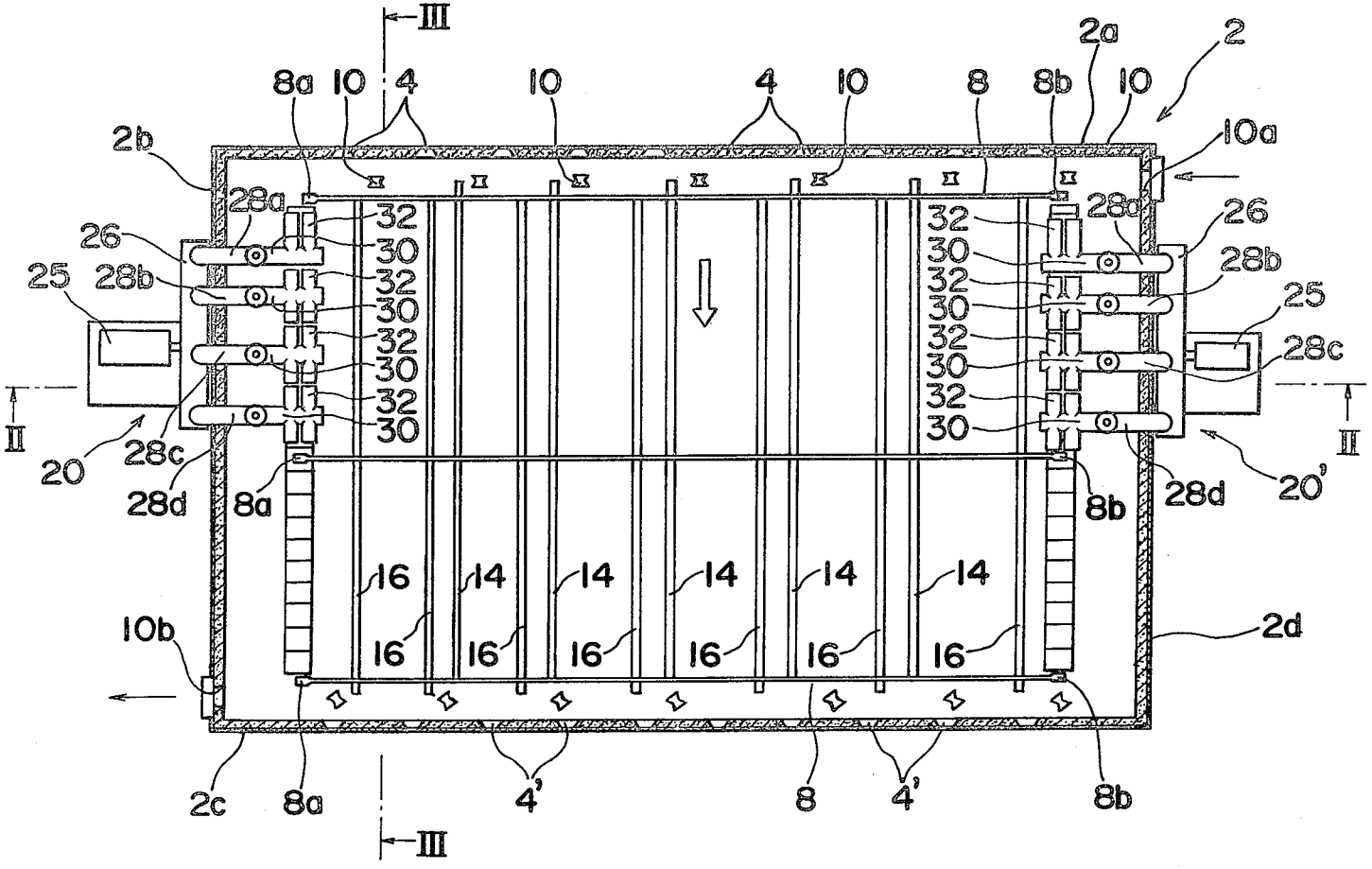
FIG. 1 is a top plan view of a heating furnace with a roof of the furnace being removed, showing the installation of a local heating device, according to the present invention.
Figure 2:
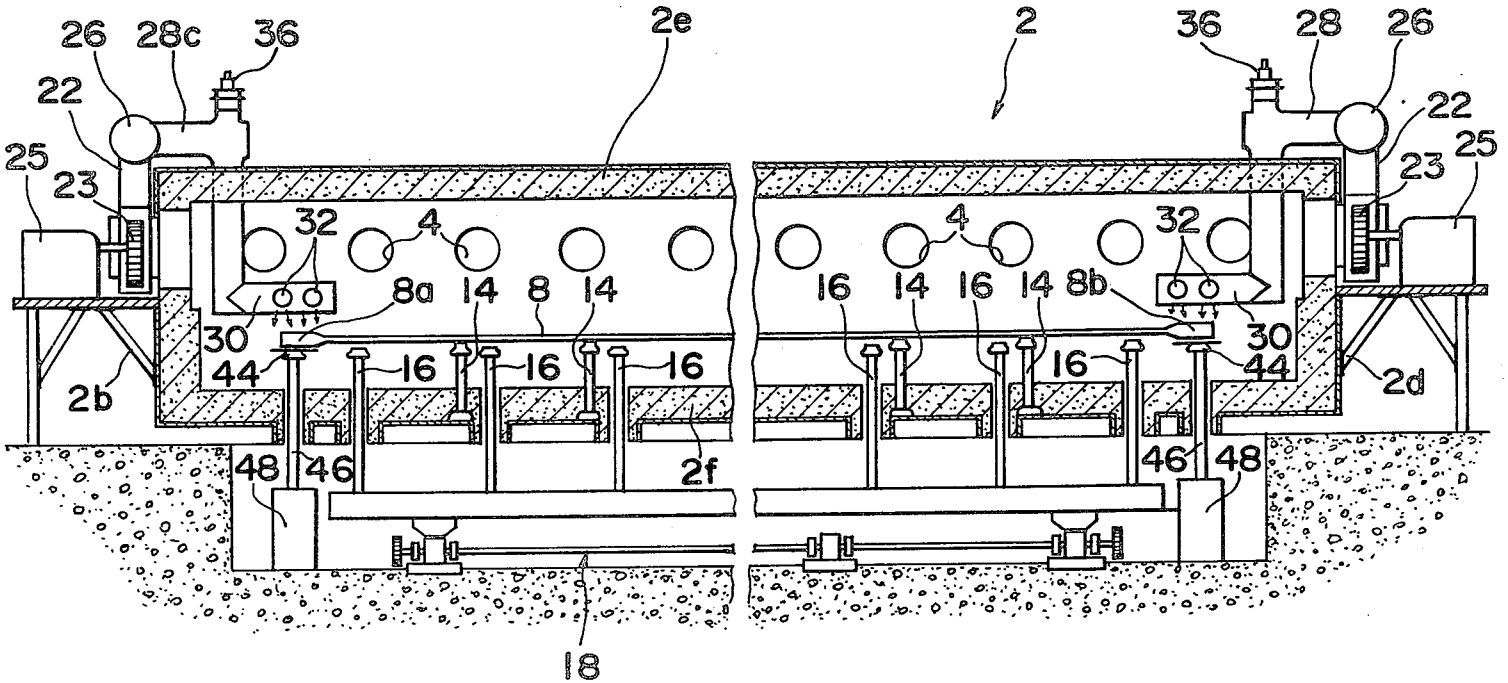
FIG. 2 is a cross-sectional view taken along a line II—II shown in FIG. 1 with the roof.
Figure 3:
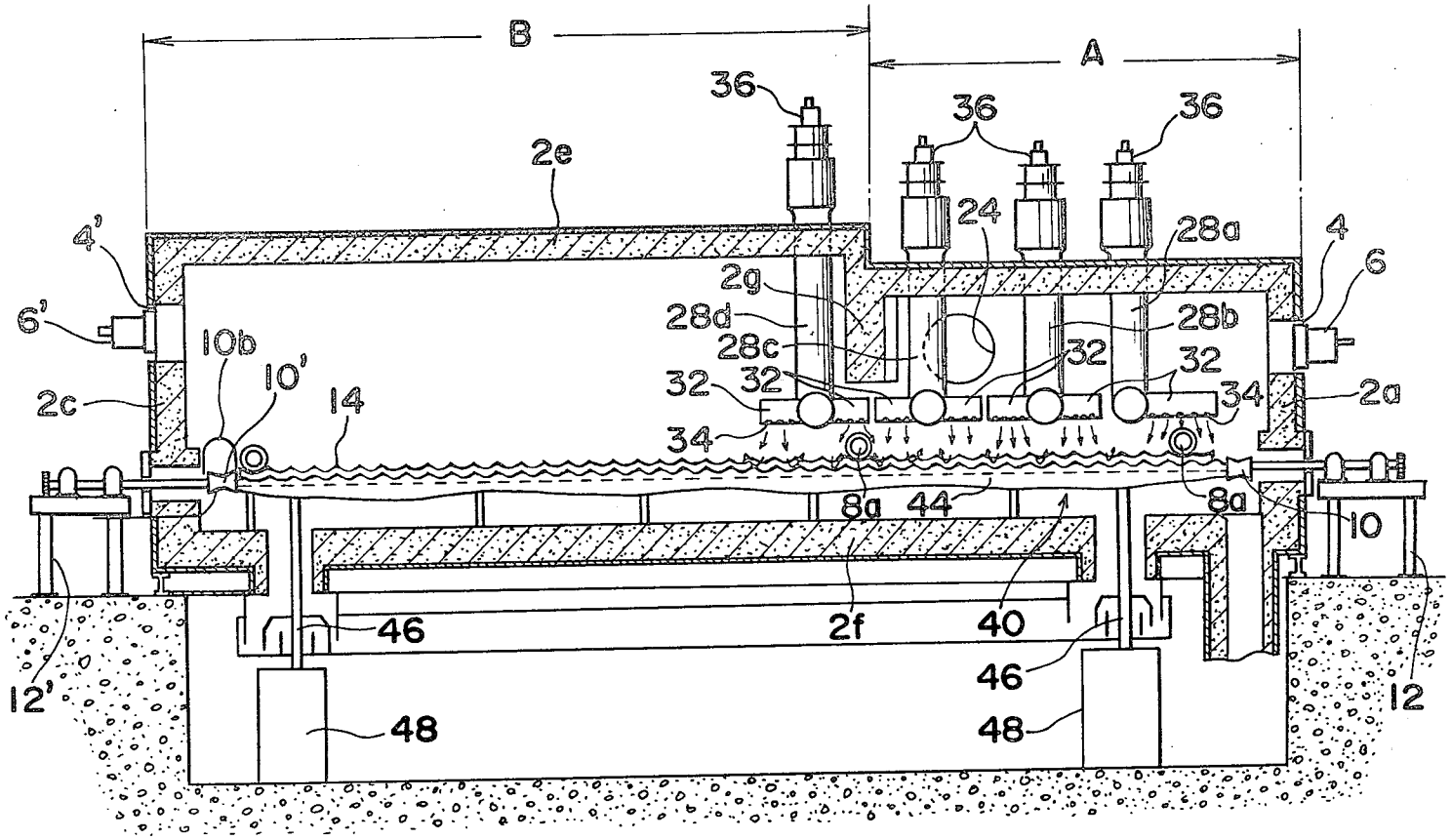
FIG. 3 is a cross-sectional view taken along a line III—III shown in FIG. 1 with the roof.

Referring to FIGS. 1, 2 and 3, a heating furnace 2 is generally defined by side walls 2*b* and 2*d*, end walls 2*a* and 2*c*, roof 2*e* (FIG. 2 or 3) and hearth 2*f*, forming a heating chamber therein. The end wall 2*a* is provided with a plurality of openings 4 (best shown in FIG. 2) for providing burners 6 (best shown in FIG. 3). Similarly, the end wall 2*c* facing the end wall 2*a* is provided with a plurality of openings 4', and in which the burners 6' are installed. The furnace 2 is divided into heating section A and soaking section B, as shown in FIG. 3, by a partition wall 2g which extends from the roof 2e. Thus, as the pipes 8 are conveyed in the furnace 2 in a manner described below, they are heated rapidly in the section A to bring their temperatures roughly to the required level, and are heated moderately in the section B to bring their temperatures uniformly and accurately to the required level.

Pipes 8, each having upset portions 8a and 8b at its opposite ends, are inserted through an entry port 10a formed in the wall 2d adjacent to the wall 2a, and are brought into the furnace 2 onto skewed rollers 10 disposed in a predetermined pitch and each driven by a drive 12 (FIG. 3). The rollers 10 carry the pipe 8 along the end wall 2a until the pipe 8 is properly positioned in the furnace 2.

Movable beams 16 lift the pipe 8 off the rollers 10 and place it on stationary beams 14 which extend parallel to each other and across the furnace above the hearth 2f. Movable beams 16 are provided parallel to and adjacent to the stationary beams 14, and are actuated by a beam driver 18 (FIG. 2) to carry out a motion such as, circular motion, elliptical motion, or rectangular motion of up-forward-down-rearward movements. When the movable beams 16 are actuated, the pipes 8 are lifted up above the stationary beams 14 and are deposited back on the stationary beams 14 at a point closer to the opposite side wall 2c of the furnace 2. The pipes 8 while moving across the beams are also rotated about their own axes. This action continues until the pipe 8 has been moved the full width of the furnace. Then, by the motion of the movable beams 16, the pipe 8 moves from the stationary beams 14 to another set of skewed rollers 10'. Thereafter, by the rotation of the skewed rollers 10', the pipe 8 is taken out from the furnace 2 through an exit port 10b formed in the side wall 2b adjacent to the wall 2c. The detail of the skewed rollers 10 and 10', the beams 14 and 16, and their associated parts, is disclosed, e.g., in Charles MacGregor's U.S. Pat. No. 2,858,122.

Figure 4:
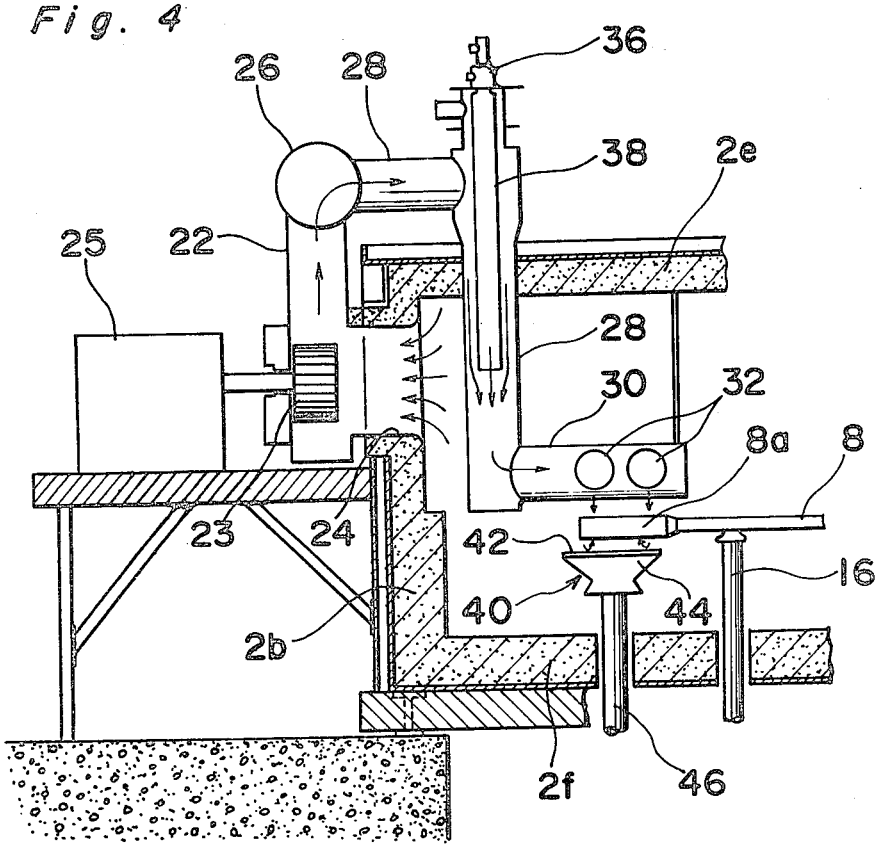
FIG. 4 is a fragmentary view showing the detail of a local heating device.

The furnace 2, according to the present invention, is further provided with a local heating device 20 at an upper left hand side portion, when viewed in FIG. 1, and a similar local heating device 20' at an upper right hand side portion. As shown in FIG. 4, the local heating device 20 comprises a main duct 22 extending externally of the furnace 2 and having one end connected to an intake opening 24 formed in the side wall 2b of the furnace 2 and the other end connected to a junction duct 26. A fan 23, driven by a motor 25, is provided in the main duct 22 adjacent to the intake opening 24 for taking the high temperature gas from the furnace 2 into the main duct 22. From the junction duct 26, there extends four branch ducts 28a, 28b, 28c and 28d (generally designated as 28), each extending along the outer surface of the roof 2e and entering into the furnace 2 through a suitable opening formed in the roof 2e. The end of each of the branch ducts 28, located inside the furnace 2 and adjacent a plane in which the pipes 8 are conveyed, is connected with a guide duct 30 which extends at a right angle to the side wall 2b. The guide duct 30 is in turn connected with at least one, e.g., four nozzle ducts 32; two nozzle ducts extending parallelly to each other from one side of the guide duct 30; and the remaining two nozzle ducts extending parallelly to each other from the opposited side of the guide duct 30, so that the nozzle ducts on the opposite sides of the guide duct 30 are axially aligned with each other, and with their axes aligned in parallel relation to the beams 14 and 16. Each of the nozzle ducts 32 is formed with a plurality of nozzles 34 along its side facing downwardly. Such nozzles 34 may be also formed in the guide ducts 30.

As best shown in FIG. 4, each of the branch ducts 28a, 28b, 28c and 28d is further provided with an auxiliary burner 36 having an outlet duct 38 disposed and opened inside the branch duct 28. Thus, the high temperature gas obtained from the furnace through the intake opening 24 is mixed with the high temperature gas generated from the auxiliary burner 36, and such a mixed high temperature gas is blown out downwardly through the nozzles 34.

Figure 5:
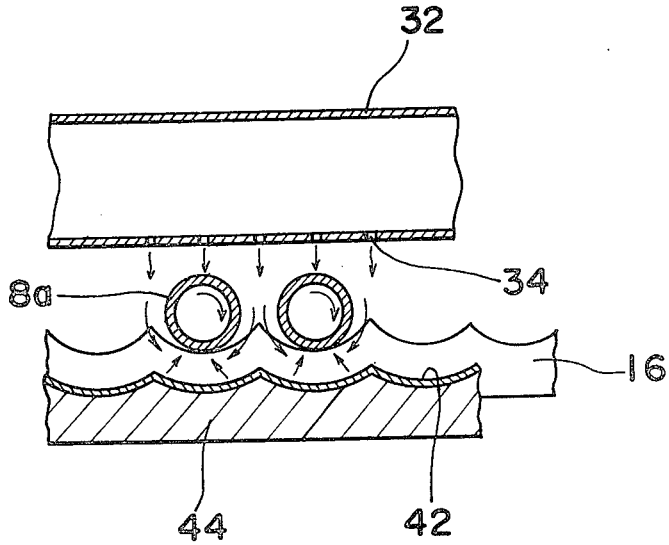
FIG. 5 is a diagrammatic view showing a manner in which upset portions of pipes are heated by the local heating device.

According to the present invention, the local heating device 20 further comprises a reflector 40, which is defined by a reflection plate 42 located under, and spaced a predetermined distance from the nozzle ducts 32 for reflecting blown out gases. The upset portion 8a, while the pipe 8 is moving across the beams, moves past the space intermediately between the nozzle ducts 32 and the reflection plate 42 for receiving high temperature gas directly from the nozzle 34 and high temperature gas reflected from the reflection plate 42. The reflection plate 42 is preferably formed by arcuate faces occurring one after another as in a wavelike fashion, such as shown in FIG. 5, to intensify the reflected gases towards upset portion 8a. The reflection plate 42 not only reflects the blown out gases, but also radiates heat. Thus, the heating of the upset portion 8a by the local heating device 20 can be carried out effectively and efficiently.

The reflector 40 further comprises a carrier beam 44 for carrying the reflection plate 42, and at least one, such as two shown in FIG. 3, support posts 46 for supporting the carrier beam 44. A suitable adjusting means 48 may be provided in association with the support post 46 for adjusting the level of the reflection plate 42.

The local heating device 20' provided on the opposite side of the furnace 2 has the same structure as the device 20 described above.

According to the preferred embodiment of the present invention, the local heating devices 20 and 20' are provided for the most part in the heating section A, and in the above-mentioned embodiment, the branch ducts 28a, 28b and 28c are provided in the heating section A, while the branch duct 28d is provided in the soaking section B, but closely adjacent to the section A.

The furnace 2 of the present invention operates in the following manner.

When the pipe 8 having upset portions 8a and 8b at its opposite ends enters into the furnace 2 from the entry port 10a, it advances laterally by the movable beams 16 through the heating section A and then through the soaking section B. When the pipe 8 is in the heating section A, the whole pipe is heated rapidly by the high temperature gases blowing out from the burners 6 and by the radiated heat from the side walls 2a and 2d, end walls 2a and 2c, roof 2e and hearth 2f of the furnace 2 and, at the same time, the upset portions 8a and 8b are further heated by the aid of local heating devices 20 and 20', respectively. Thus, when the pipe 8 is about to enter into the soaking section B, a body portion of the pipe 8 (a portion other than the upset portions 8a and 8b) is roughly heated up to the required temperatures, and the upset portions 8a and 8b are also roughly heated up to the required temperatures. This means that, by the aid of local heating devices 20 and 20', the upset portions 8*a* and 8*b* can be heated roughly up to the required temperatures approximately in the same period of time as that required to roughly heat the body portion of the pipe 8 by the burners 6 in the section A.

Then, when the pipe 8 enters the soaking section B, it is heated uniformly and accurately throughout to the required temperatures by the high temperature gases blowing out from the burners 6' and by the radiated heat from the side walls 2*b* and 2*d*, end walls 2*a* and 2*c*, roof 2*e* and hearth 2*f* of the furnace 2. Thereafter, the heated pipe 8 leaves the furnace 2 through the exit port 10*b*.

According to the preferred embodiment of the furnace 2 described above, pipes are fed into the furnace 2 one after another with a predetermined time interval and, therefore, a plurality of pipes may be in the furnace 2 with a predetermined pitch spaced from each other.

Figure 6:
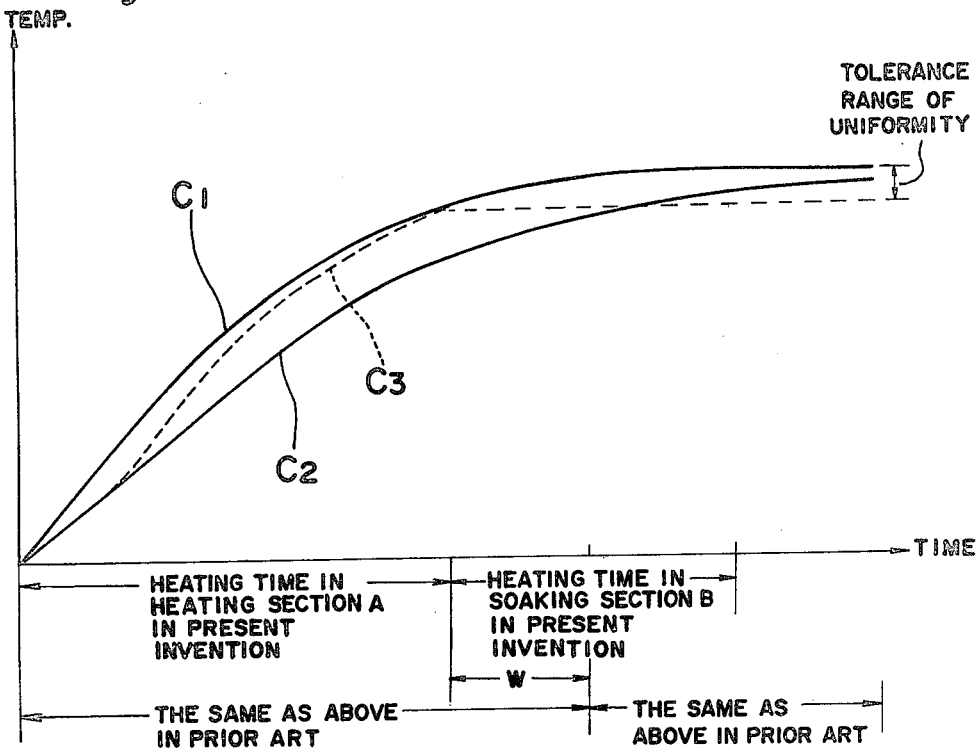
FIG. 6 is a graph showing a relationship between the temperature of the material to be heated and time.

Referring to FIG. 6, a graph depicted therein shows the temperature change of the pipe 8 in the furnace. In the graph, abscissa and ordinate represent time and temperature, respectively, and to obtain the curves depicted in the graph, a pipe having a diameter of 73.0 mm and thickness of 5.51 mm at the body portion and a diameter of 78.6 mm and thickness of 8.31 mm at the opposite end upset portions is used. In the graph, a curve C1 shows the temperature change of the body portion of the pipe, a curve C2 shows the temperature change of the upset portion of the pipe heated in a prior art furnace, i.e., a furnace without the local heating device, and a curve C3 shows the temperature change of upset portion of the pipe heated in the furnace of the present invention, i.e., a furnace with the local heating devices.

As apparent from the curve C2 in the graph, the upset portion, when it is heated in the furnace of the prior furnace of the present invention is employed, the total heating time can be shortened 15–20% of the total heating time required by the furnace of the prior art.

It is to be noted that, according to the present invention, the auxiliary burner in each of the branch ducts 28*a*, 28*b*, 28*c* and 28*d* can be eliminated to blow out the high temperature gas only by the circulated gas from the furnace.

It is also to be noted that the positions of nozzle ducts and the reflection plate can be in opposite relation to the embodiment described above. That is, the nozzle ducts are so positioned as to shoot up the high temperature gas towards the reflection plate with the upset portions being conveyed in a space therebetween.

Figure 7:
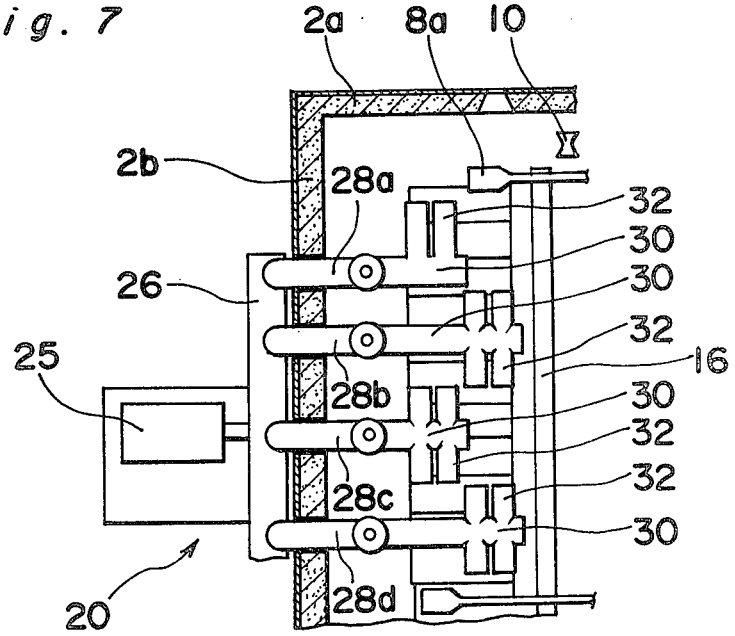
FIG. 7 is a fragmentary view showing a modification of a local heating device.

It is also to be noted that the nozzle ducts 32 can be disposed in a zigzag form, as shown in FIG. 7, to permit the local heating in wider region, thus permitting the local heating of upset portions of rather long sizes. Furthermore, in this case, a suitable valve means or the like may be provided in the junction duct 26 to allow the flow of the high temperature gas selectively to the short branch ducts 28*a* and 28*c*, or to the long branch ducts 28*b* and 28*d*, or to all of them to cope with various kinds of pipes.

It is further to be noted that the nozzle ducts 32 having nozzles can be formed in any other shape, for example, a rectangular box with a plurality of nozzles.

What is claimed is:

1. An improved furnace for heat treatment of objects requiring a variant rate of heat transfer to different portions of the object such as an elongated workpiece with an expanded end, comprising:

a heating chamber housing to permit the establishment of a predetermined temperature distribution within the housing for heat treatment of the object;

means for conveying the object through the housing in a predetermined spatial position so that the portion of the object requiring a higher rate of heat transfer is confined to a particular path of travel;

means for providing a flow of high temperature gas to the housing and towards at least a portion of the particular path of travel, and means for reflecting the flow of high temperature gas passing beyond the particular path of travel back towards the path of travel to ensure the availability of sufficient heat for the higher rate of heat transfer required by that portion of the object including a plate member defined by a series of arcuate faces occurring one after another, the plate member further capable of being heated to a temperature to radiate additional heat energy towards the particular path of travel.

2. The invention of claim 1 wherein the means for providing a flow of high temperature gas includes means for recirculation of high temperature gases from the heating chamber housing.

3. The invention of claim 2 further including means for providing an auxiliary source of high temperature gas to supplement the recirculated high temperature gas and means for controlling the auxiliary source.

4. The invention of claim 1 further comprising means for adjusting the position of the plate member relative to the path of travel.

5. The invention of claim 1 wherein the heating chamber is divided into a first section which substantially supports the means for providing a flow of high temperature gas and a second section for providing a constant heat treatment of the object.

6. An improved furnace for heat treatment of objects requiring a variant rate of heat transfer to different portions of the object such as an elongated workpiece with an expanded end, comprising:

a heating chamber housing to permit the establishment of a predetermined temperature distribution within the housing for heat treatment of the object;

means for conveying the object through the housing in a predetermined spatial position so that the portion of the object requiring a higher rate of heat transfer is confined to a particular path of travel;

means on one side of the path of travel for providing a flow of high temperature gas to the housing and towards at least a portion of the particular path of travel, and means for reflecting the flow of high temperature gas passing beyond the particular path of travel back towards the path of travel to ensure the availability of sufficient heat for the higher rate of heat transfer required by that portion of the object, including an extended multi-faced plate member positioned on the other side of the path of travel, each face of the plate member having an arcuate configuration with a concave surface facing the path of travel.

7. The invention of claim 6 further including means for adjusting the position of the plate member relative to the path of travel.

8. The invention of claim 7 wherein the nozzle means are positioned in a zigzag manner along the path of travel.

9. The invention of claim 6 wherein the means for providing a flow of high temperature gas includes nozzle means for directing the gas at arcuate plate member surfaces.

10. The invention of claim 6 wherein the heating chamber is divided into a first section which substantially houses the means for providing a flow of high temperature gas and a second section for providing a constant heat treatment of the object.

11. The invention of claim 6 wherein the means for providing a flow of high temperature gas includes means for recirculation of high temperature gases from the heating chamber housing.

12. The invention of claim 11 further including means for providing an auxiliary source of high temperature gas to supplement the recirculated high temperature gas and means for controlling the auxiliary source.

* * * * *